US005394313A

United States Patent [19]

Dezelan et al.

[11] Patent Number: 5,394,313

[45] Date of Patent: Feb. 28, 1995

[54] LAMP ASSEMBLY WITH INTEGRAL BULB REPLACEMENT TOOL

[75] Inventors: Denise M. Dezelan, Royal Oak; Edward L. Monroe, Shelby Township, Macomb County, both of Mich.

[73] Assignee: General Motors Corporation, Detroit, Mich.

[21] Appl. No.: 130,332

[22] Filed: Oct. 1, 1993

[51] Int. Cl.[6] ..... B25B 33/00

[52] U.S. Cl. ..... 362/119; 362/226; 362/253; 362/457; 7/169; 81/53.1

[58] Field of Search ..... 7/107, 138, 151, 169, 7/170; 81/53.1, 53.11; 362/109, 119, 120, 226, 253, 254, 437, 439, 457, 458

[56] References Cited

U.S. PATENT DOCUMENTS

| | | | |
|---|---|---|---|
| Re. 32,899 | 4/1989 | Laidman | 362/226 |
| D. 292,168 | 10/1987 | Seltzer et al. | D8/14 |
| 1,023,077 | 4/1912 | Grout | 81/3.8 |
| 3,135,470 | 2/1964 | Prescott et al. | 362/254 |
| 3,654,824 | 4/1972 | Reed | 81/3.8 |
| 3,879,778 | 4/1975 | Archer | 7/169 |
| 4,323,953 | 4/1982 | Hutchison | 362/226 |
| 4,414,611 | 11/1983 | Seltzer et al. | 362/254 |
| 4,852,925 | 8/1989 | Lodin | 294/2 |
| 5,245,518 | 9/1993 | Aspenwall | 362/226 |

*Primary Examiner*—Ira S. Lazarus
*Assistant Examiner*—Alan B. Cariaso
*Attorney, Agent, or Firm*—Jeffrey A. Sedlar

[57] ABSTRACT

A lamp assembly that includes a lens with an integral bulb replacement tool. A replaceable lamp bulb will be contained within a lamp housing. The housing has an opening allowing light to emanate, that is enclosed by a removable transparent lens. Formed integrally with the lens is a tool member that, in conjunction with the lens portion operating as a handle, may be used for removal of the lamp bulb from the housing and replacement.

5 Claims, 3 Drawing Sheets

LAMP ASSEMBLY WITH INTEGRAL BULB REPLACEMENT TOOL

BACKGROUND OF THE INVENTION

This invention pertains to a lamp assembly with a lens that doubles as a bulb replacement tool, more specifically to a lamp assembly with a lens that has a formed extension for use as a tool in bulb replacement with the lens portion serving as a handle for the extending tool member.

Lamp assemblies are common everyday items encountered in most manufactured environments. Lamp assemblies come in many forms including freestanding models, models designed for mounting on a flat surface and models designed for recessed mounting through an opening in a flat surface. Usually the bulb, also known as a lamp, that is contained in a lamp assembly will bum out. Therefore a bulb is usually replaceable. Often the aid of some sort of tool is necessary or preferable to replace the bulb. This need or preference may arise because access to the bulb is restricted, the additional leverage of a tool is helpful, or because contact with surfaces within the lamp assembly is preferably avoided.

Tools made specifically for the purpose of bulb replacement are commonly known devices. These tools provide a device for prying on or grasping the bulb for removal from the socket and replacement. When such a tool is required one must first be located and obtained, usually from a location remote from the lamp assembly and at an additional cost above and beyond that of the lamp assembly itself. Otherwise a substitute tool, one not particularly tailored for the job at hand, may be used.

Attempts may be made to overcome the inconvenience of obtaining an appropriate tool by using an available one such as pliers, a screw driver, or fingers. These attempts have obvious drawbacks. In manufactured environments such as those of an automobile interior where the power source is not as conveniently turned off as it is in a house, the use of an improper conductive tool may lead to a short circuit and a blown fuse, complicating the otherwise simple task of replacing a burned out bulb. In this type of compact environment the amount of space available to access the bulb is more likely to be severely restricted so that a particular bulb replacement tool is required. Due to the foregoing, complications continue to be associated with the task of replacing burned out bulbs, therefore, problems exist.

SUMMARY OF THE INVENTION

The present invention is a lamp assembly that has a tool designed for use in replacing the bulb integrated into the lamp's lens. The assembly includes a housing within which a bulb will be contained by a socket. The housing has an opening allowing light to emanate outwardly. The opening is enclosed by a transparent lens through which the light is directed out of the housing. Upon the lens is formed an integral bulb replacement tool member.

The shape and form of the tool member is determined for a given application by reference to the details of the lamp assembly. In the case of a cylindrically shaped cartridge lamp contained within a recessed housing, a convenient shape is that of a hook or a crook. This form is appropriate for capturing the bulb within the housing and pulling it out, and also for holding a new bulb for insertion back into the socket. An L-shaped tool or a simple prying blade shaped similarly to a flat headed screw driver with a slight curve on the end may also adequately serve the purpose of aiding in the removal of the bulb from the housing.

It is preferable that the lens be of a size and shape that can be utilized as a handle, so that it may be removed from the housing and conveniently held to manipulate the projecting tool feature. The tool feature is designed to fit within the lamp assembly and dislodge the bulb while the lens itself is held as a handle for removal and replacement of the bulb.

In a preferred form the tool member which projects from the lens will be concealed within the lamp housing when the lens is attached to the housing. This may be accomplished by providing a lamp housing with sufficient interior space to allow the tool to slip inside through a slit opening or through the opening enclosed by the lens. Alternatively, a bezel may be provided, as in the case of a recessed lamp assembly, behind which the tool feature is concealed, when the lens is attached to the housing.

The lens is preferably attached to the lamp housing so that it is readily removable. A simple method for attaching a semi-flexible plastic lens is with retaining tabs on the lens that fit into slots in the housing or the bezel. The tabs can be relatively small so not to interfere with using the lens as a tool. Removal of the lens can be accomplished by simply forcing the tabs out of their retaining slots.

A purpose of the invention is to make bulb replacement convenient. This is accomplished by locating the bulb replacement tool on the lamp lens itself, which likely will be removed from the assembly to replace the bulb. The lens with integral bulb replacement tool may allow removal of a bulb that is inaccessible with fingers or other standard hand tools. The fact that the tool is tailored to the job at hand and shaped for the specific bulb within the assembly, creates greater ease in replacing the bulb.

Other objects, features and advantages of the invention will become apparent from the following description and the drawings of the presently preferred embodiment thereof.

DESCRIPTION OF A PRESENTLY PREFERRED EMBODIMENT

Figure 1:
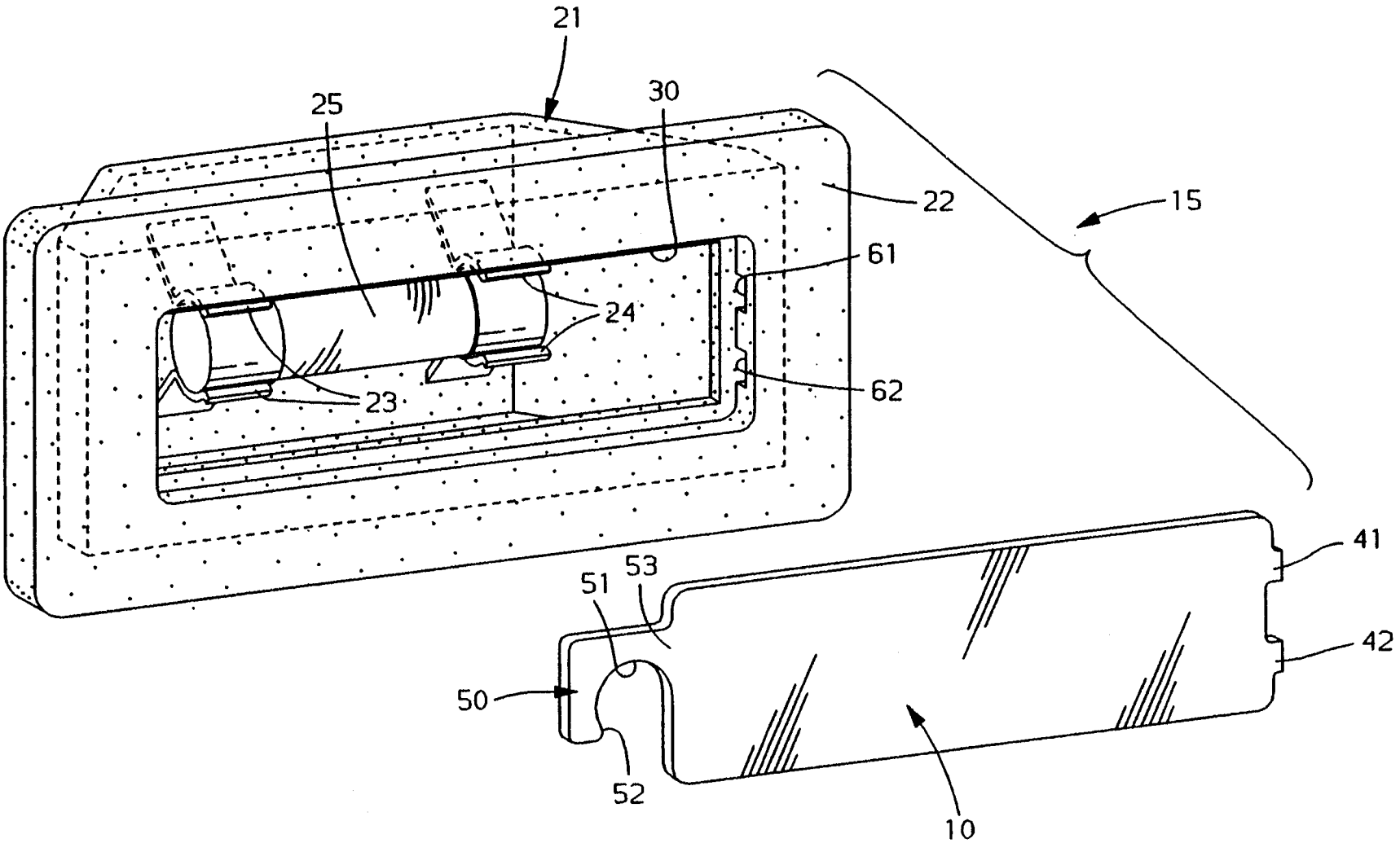
FIG. 1 is a partially exploded perspective view of a recessed lamp assembly for use in an automobile interior showing the lens removed.

Referring to the drawings, FIG. 1 shows an assembly of the component parts of a recessed lamp assembly designated in the aggregate as 15, of a type used in the interior of an automobile, with the lens 10, shown separated from the housing 21. The component parts include the housing 21, having an opening around which the bezel 22, is connected. The bezel 22, partially encloses the housing opening and conceals any gap remaining when the recessed lamp assembly 15, is mounted in a surface. Connecting the bezel 22, to the housing 21, leaves a remaining opening 30, coextensive with a majority of the housing opening and revealing the lamp assembly's interior. A dual clip type socket 23 and 24, for receiving the cartridge lamp bulb 25, is located within the housing 21, from which connection can be made to an electrical source. The lens 10, for enclosing the opening 30, has an integral bulb replacement tool feature 50. The lens 10, may have cross hatching or other irregularity on the interior surface which can diffuse the emanating light or obscure the housing's interior when the lens is attached.

Figure 3:
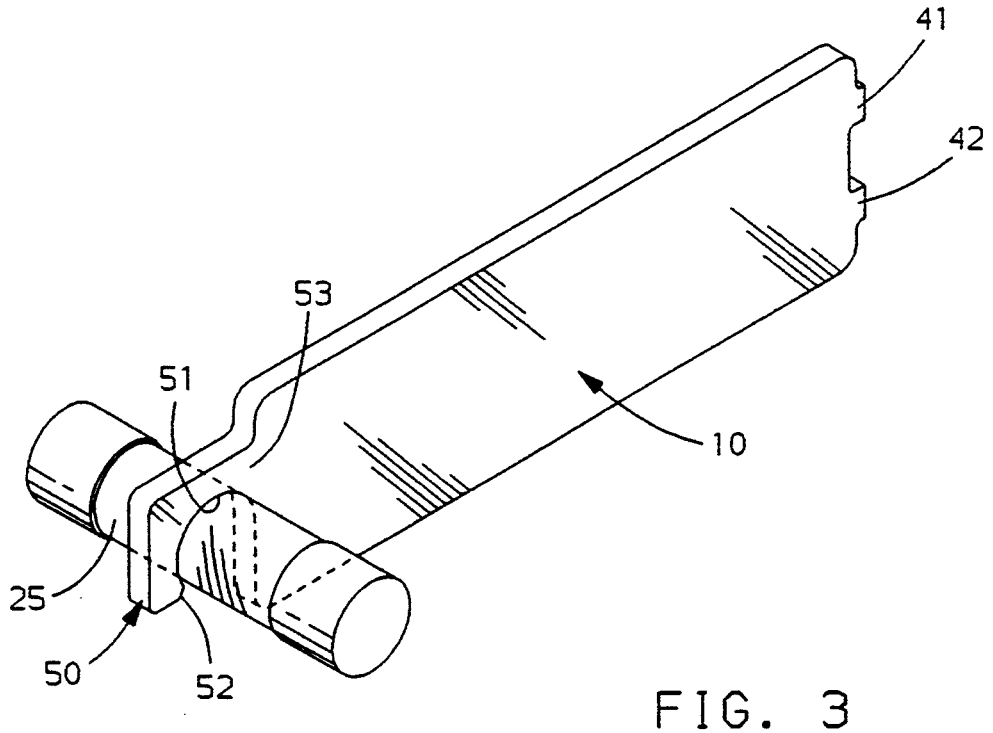
FIG. 3 is a perspective view of a lens and integral bulb replacement tool with a cartridge lamp captivated.

The lens 10, with integral bulb replacement tool member 50, as shown in FIG. 1 is removable. The lens 10, is rectangular and elongated, which is a convenient shape for holding in the hand and appropriately serves as a handle for the tool feature 50. Other shaped lenses can similarly serve the purpose of a handle while allowing for design flexibility in the lens and lamp assembly. The tool feature 50, is hook-shaped for grasping a cylindrical shaped cartridge bulb 25, although the shape and form will be determined individually for each application according to the lamp assembly details. The arcuate surface 51, is shaped to slip around the outer circumference of the cartridge bulb 25 with sufficient clearance to permit insertion through opening 30, and engagement of the tool 50, on the bulb 25. The hook's lip 52, is located a distance from the hook's shank 53, to provide a light snap fit around the bulb 25, as shown in FIG. 3. However, the shape of the tool may be that of a prying-blade, with a wedge shaped end similar to one found on a flat-head screwdriver or otherwise appropriately shaped to dislodge the bulb from the assembly where captivation for reinsertion is not necessary.

The bulb replacement tool member 50, is preferably formed of the same material as the lens 10, and by the same process used to create the lens and such additional processing as may be required to properly create the tool member. Preferably the lens and tool member will be formed simultaneously from a relatively high strength polymer with a relatively high softening temperature such as polycarbonate. This type of material is commonly used for impact-resistant lamp lenses, is nonconductive, and will not create an electrical short when inserted into the lamp housing.

Figure 4:
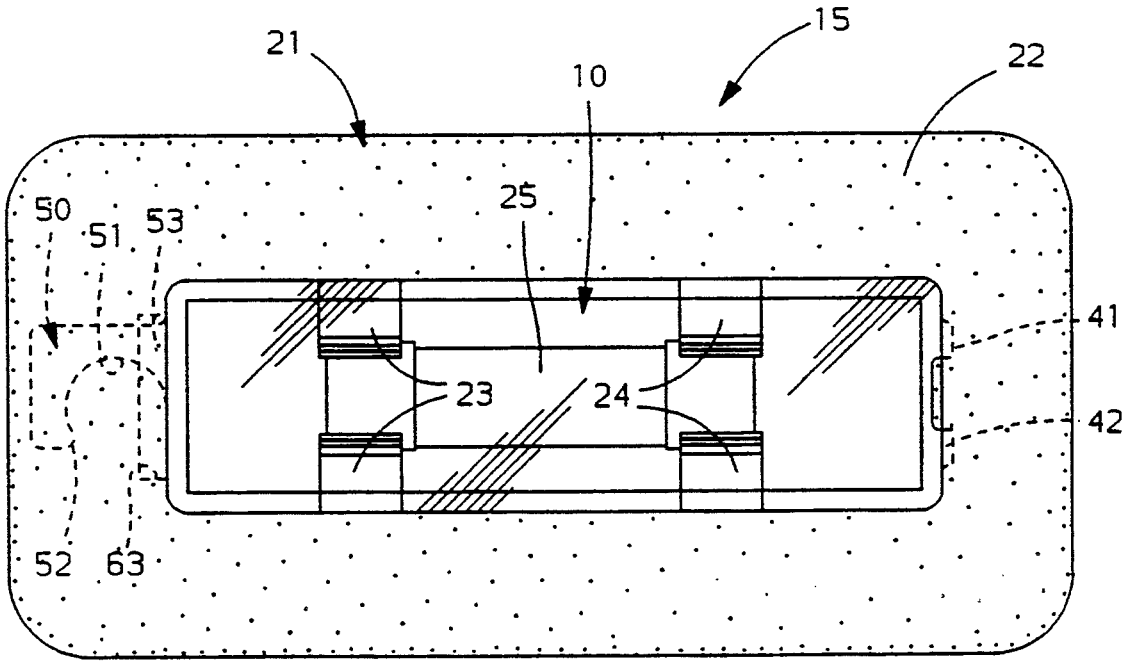
FIG. 4 is a front view of the assembly of FIG. 1 showing the tool feature concealed by the bezel.

Referring to FIG. 1 and FIG. 4 together, the tabs 41 and 42, in combination with the tool member 50 slip behind the bezel 22 through slots 61, 62 and 63, to provide a means for attaching the lens to the lamp assembly. In the preferred embodiment, the lens is made from a semi-flexible material so that the tabs can be readily disengaged from the slots for removal of the lens from the assembly. The bulb replacement tool member 50, is concealed by the bezel 22, when the lens 10, is attached to the assembly 15, as shown in FIG. 4. This is facilitated if the lens portion and the tool member are substantially flat and co-planar. Alternately, the tool member may be positioned inside the housing with the lens attached to the housing by independent means that allow for quick removal of the lens.

Figure 2:
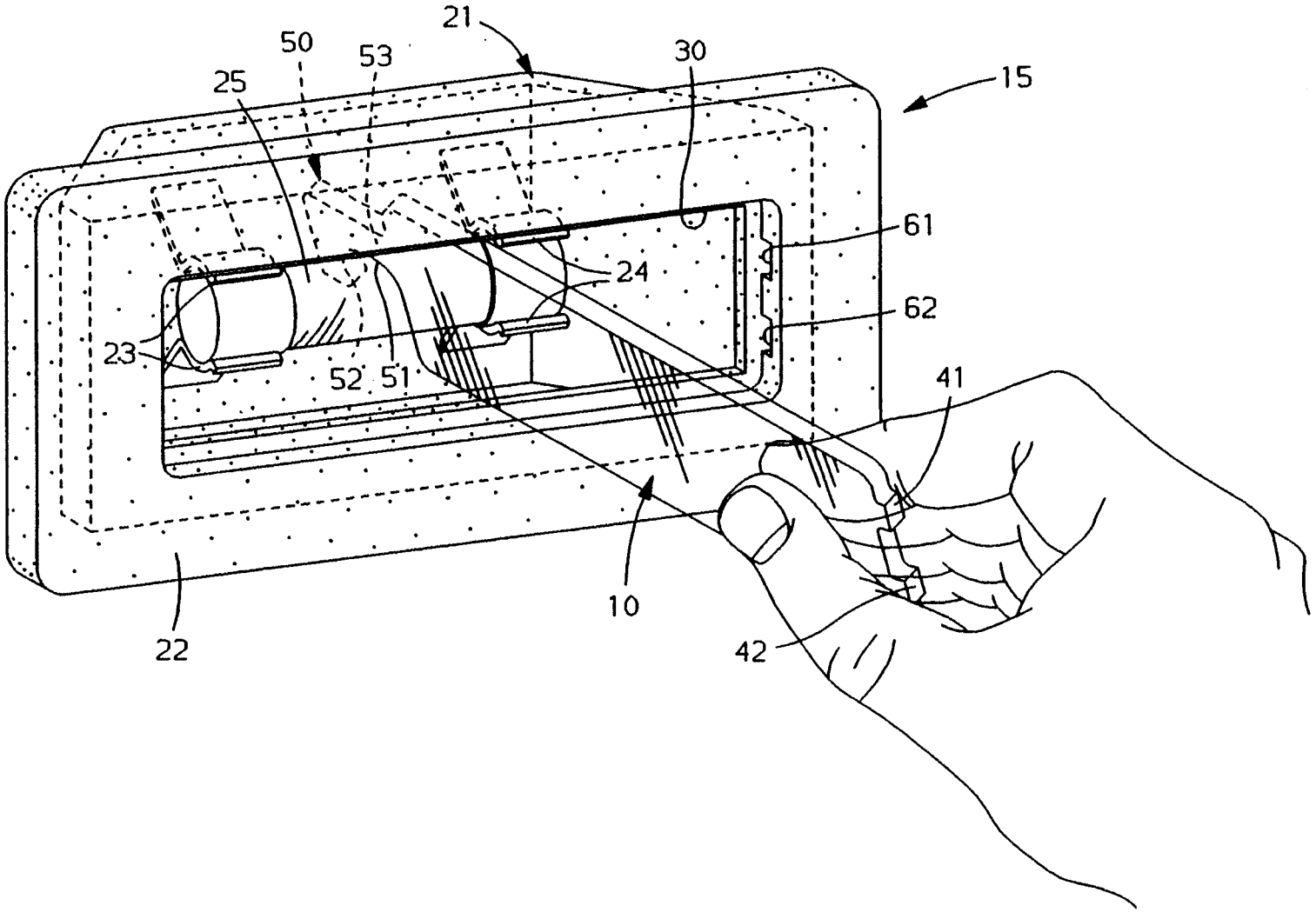
FIG. 2 is a perspective view of the lamp assembly of FIG. 1 with the lens removed and being used as a bulb replacement tool.

FIG. 2 illustrates the removal of the bulb 25, using a presently preferred embodiment of the lens 10, with integral bulb replacement tool feature 50. The housing 21, and bezel 22, exhibit the opening 30, when the lens 10, is removed. The lens 10, is held as a handle, and the tool member 50, inserted through the bezel and housing opening 30. The lens is then twisted and the arcuate surface 51, surrounds the bulb 25. The bulb 25, may then be dislodged from the clips 23 and 24, and extracted through the opening 30, by pulling on the lens 10, as a handle.

FIG. 3 shows the bulb 25, captivated by the tool member 50, which is an integral member of the lens 10. The captivation of the bulb may be accomplished for extraction of a burned out bulb and for insertion of a new bulb. Although the presently preferred embodiment includes a tool member 50, that captivates the bulb, a tool adequate to dislodge the bulb may take other forms that do not clip around the bulb. In applications where the replacement lamp can be placed in the socket by hand but a tool is helpful in removing the bulb, captivation of the bulb for reinsertion is not necessary.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. A lamp assembly comprising:
a lamp housing having an opening;
a lamp socket within the lamp housing; and
a removable transparent lens enclosing the opening in the lamp housing, the lens having a bulb replacement tool member extending from the periphery of the lens wherein the bulb replacement tool member and the lens are substantially flat and co-planar.

2. A lamp assembly comprising:
a housing with an opening revealing the housing's interior;
a receptive socket within the housing;
a replaceable lamp bulb adapted to be contained by the receptive socket; and
a removable transparent lens enclosing the housing opening, the lens having a bulb replacement tool member formed on the periphery of the lens, the bulb replacement tool member shaped for insertion through the housing opening to dislodge the lamp bulb, wherein the lens may be detached from the housing and inserted into the housing, tool member first, to remove the lamp bulb from the receptive socket and replace it.

3. A lamp assembly according to claim 2, wherein the removable transparent lens has a plurality of lens retaining tabs formed on the periphery of the lens, one lens retaining tab extending outward substantially away from the lens body forming the bulb replacement tool member.

4. A recessed lamp assembly comprising:
a housing for recessed mounting with an opening in the housing facing outward;
a lamp socket within the housing for containing a lamp and connecting the lamp to an electrical power source;
a removable lamp lens enclosing the housing opening, the lamp lens including a bulb replacement tool member extending from the perimeter of the lamp lens;
a bezel surrounding the housing opening wherein the bezel conceals the tool member.

5. A recessed lamp assembly according to claim 4, further comprising a cylindrical-shaped lamp bulb and wherein the bulb replacement tool member is hook shaped for captivating the cylindrical shaped lamp bulb.

* * * * *